US009540966B2

(12) United States Patent
Zurface

(10) Patent No.: US 9,540,966 B2
(45) Date of Patent: Jan. 10, 2017

(54) OIL CONTROL VALVE SYSTEM FOR VALVE ACTUATION SWITCHING

(71) Applicant: Eaton Corporation, Cleveland, OH (US)

(72) Inventor: Austin Robert Zurface, Hastings, MI (US)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 14/867,569

(22) Filed: Sep. 28, 2015

(65) Prior Publication Data

US 2016/0017774 A1 Jan. 21, 2016

Related U.S. Application Data

(63) Continuation of application No. PCT/US2014/031991, filed on Mar. 27, 2014.

(60) Provisional application No. 61/807,553, filed on Apr. 2, 2013.

(51) Int. Cl.

| | |
|---|---|
| ***F01L 9/02*** | (2006.01) |
| ***F01L 1/26*** | (2006.01) |
| ***F01L 13/00*** | (2006.01) |
| ***F01L 1/18*** | (2006.01) |
| ***F01L 1/42*** | (2006.01) |

(52) U.S. Cl.

CPC ..... *F01L 9/02* (2013.01); *F01L 1/185* (2013.01); *F01L 1/26* (2013.01); *F01L 1/267* (2013.01); *F01L 1/42* (2013.01); *F01L 13/0005* (2013.01); *F01L 2013/001* (2013.01)

(58) Field of Classification Search

CPC ..... F01L 1/185; F01L 1/267; F01L 9/02; F01L 13/0005

USPC ..... 123/90.12, 90.13, 90.39, 90.44

See application file for complete search history.

(56) References Cited

U.S. PATENT DOCUMENTS

| | | | | |
|---|---|---|---|---|
| 6,732,685 | B2 * | 5/2004 | Leman | F01L 9/02 123/198 F |
| 2004/0244744 | A1 | 12/2004 | Falkowski | |
| 2007/0240659 | A1 | 10/2007 | Rozario | |

FOREIGN PATENT DOCUMENTS

| | | | |
|---|---|---|---|
| DE | 102011053333 | A1 | 3/2013 |
| WO | 03023197 | A1 | 3/2003 |

OTHER PUBLICATIONS

International Search Report and Written Opinion for International Application No. PCT/US2014/031991 mailed Jul. 7, 2014, 9 pages.

* cited by examiner

*Primary Examiner* — Ching Chang

(74) *Attorney, Agent, or Firm* — Remarck Law Group PLC

(57) ABSTRACT

An oil control valve system according to one example of the present disclosure incorporates a common or interchangeable oil control valve at distinct locations of an engine to direct operation of switching mechanisms over sets of three cylinders. In another aspect of the present disclosure, four interchangeable oil control valves are used in a six-cylinder engine. Utilizing interchangeable oil control valves minimizes design costs, reduces assembly time, lessens repair or replacement burdens, and allows for enhanced engine performance.

20 Claims, 4 Drawing Sheets

OIL CONTROL VALVE SYSTEM FOR VALVE ACTUATION SWITCHING

CROSS-REFERENCE TO RELATED APPLICATION

This application is a continuation of International Patent Application No. PCT/US2014/031991 filed on Mar. 27, 2014, which claims the benefit of U.S. Patent Application No. 61/807,553 filed on Apr. 2, 2013. The disclosures of the above applications are incorporated herein by reference.

FIELD

The present disclosure relates to oil control valve systems in engine systems. More particularly, the present disclosure relates to an oil control valve system having multiple occurrences of a common or interchangeable oil control valve that each provides a common output pressure to various engine-switching mechanisms.

BACKGROUND

Various systems have been developed for altering valve-lift characteristics for internal combustion engines. Such systems, commonly known as variable valve timing (VVT) or variable valve actuation (WA), improve fuel economy, reduce emissions, and improve driver comfort over a range of speeds.

SUMMARY

An oil control valve system according to one example of the present disclosure incorporates a common or interchangeable oil control valve at distinct locations of an engine to direct operation of switching mechanisms over sets of three cylinders. In another aspect of the present disclosure, four interchangeable oil control valves are used in a six-cylinder engine. Utilizing interchangeable oil control valves minimizes design costs, reduces assembly time, lessens repair or replacement burdens, and allows for enhanced engine performance.

An oil control valve configuration for an engine having first, second, third, fourth, fifth and sixth engine cylinders is disclosed. Each engine cylinder can have a first and a second intake valve in operable contact with a switching rocker arm. The oil control valve configuration can include a first, second, third and fourth oil control valve. The first oil control valve can be in operable pressure communication with switching mechanisms of a first and second switching rocker arm of the first engine cylinder, and a switching mechanism of a first switching rocker arm of the second cylinder. The second oil control valve can be in operable pressure communication with switching mechanisms of a first and second switching rocker arm of the third engine cylinder, and a switching mechanism of a second switching rocker arm of the second cylinder.

The third oil control valve can be in operable pressure communication with switching mechanisms of a first and second switching rocker arm of the fourth engine cylinder, and a switching mechanism of a first switching rocker arm of the fifth cylinder. The fourth oil control valve can be in operable pressure communication with switching mechanisms of a first and second switching rocker arm of the sixth engine cylinder, and a switching mechanism of a second switching rocker arm of the fifth cylinder.

The first, second, third and fourth oil control valves can each be configured to provide a common output pressure to a switching mechanism of each respective switching rocker arm for a predetermined input pressure. In one example, each of the first, second, third and fourth oil control valves are interchangeable. The first, second, third and fourth oil control valves can be common oil control valves relative to each other.

According to some implementations, the first and second intake valves attached to the first engine cylinder open from about 30 to about 300 crank angle degrees. The first and second intake valves attached to the second engine cylinder open from about 270 to about 540 crank angle degrees. The first and second intake valves attached to the third engine cylinder open from about 510 to about 60 crank angle degrees. The first and second intake valves attached to the fourth engine cylinder open from about 150 to about 420 crank angle degrees. The first and second intake valves attached to the fifth engine cylinder open from about 390 to about 660 crank angle degrees. The first and second intake valves attached to the sixth engine cylinder open from about 630 to about 180 crank angle degrees. Each oil control valve of the first, second, third and fourth oil control valves actuates a switching rocker arm associated with two distinct engine cylinders of the first, second, third, fourth, fifth and sixth engine cylinders.

In other examples, a first switching window for the first and second cylinders is open from about 275 to 30 crank angle degrees. A second switching window for the second and third cylinders is open from about 515 to 270 crank angle degrees. A switching window for the fourth and fifth cylinders is open from about 395 to 150 crank angle degrees. A switching window for the fifth and sixth cylinders is open from about 635 to 390 crank angle degrees. The first oil control valve actuates a switching rocker arm associated with the first and second cylinders throughout an engine combustion cycle. The second oil control valve actuates a switching rocker arm associated with the second and third cylinders throughout the engine combustion cycle. The third oil control valve actuates a switching rocker arm associated with the fourth and fifth cylinder throughout the engine combustion cycle. The fourth oil control valve actuates a switching rocker arm associated with the fifth and sixth cylinder throughout the engine combustion cycle.

According to additional features, an oil control valve system for an engine includes a first, second and third engine cylinder. Each cylinder has a first and second intake valve in operable contact with a switching rocker arm. The oil control valve system includes a first oil control valve and a second oil control valve. The first oil control valve is in operable pressure communication with switching mechanisms of a first and second switching rocker arm of the first engine cylinder and a switching mechanism of a first switching rocker arm of the second engine cylinder. The second oil control valve is in operable pressure communication with switching mechanisms of a first and second switching rocker arm of the third engine cylinder and a switching mechanism of a second switching rocker arm of the second engine cylinder.

In other features, the first and second oil control valves are each configured to provide a common output pressure to a switching mechanism of a switching rocker arm for a predetermined input pressure. The first and second oil control valves are interchangeable. The first and second oil control valves are common oil control valves relative to each other. The first and second oil control valves are opened for about 270 crank angle degrees. A switching window is delayed by about 5 crank angle degrees. A total switching window is about 480 crank angle degrees.

According to additional examples, a method for operating an oil control valve system fluidly coupled to a plurality of switching mechanisms provided in respective rocker arms of an engine is provided. The engine has a first, second and third cylinders. Each cylinder has a first and second intake valve that are actuated by respective first and second rocker arms. A first oil control valve is provided. The first oil control valve is in pressure communication with (i) the first rocker arm of the first cylinder, (ii) the second rocker arm of the first cylinder, and (iii) the first rocker arm of the second cylinder. A second oil control valve is provided. The second oil control valve is in pressure communication with (i) the first rocker arm of the third cylinder, (ii) the second rocker arm of the third cylinder, and (iii) the second rocker arm of the second cylinder. The first oil control valve is activated thereby actuating the first and second rocker arm of the first cylinder and the first rocker arm of the second cylinder. The second oil control valve is activated thereby actuating the first and second rocker arm of the third cylinder and the second rocker arm of the second cylinder.

In other features, the first oil control valve is activated to provide a first pressure at the first and second rocker arms of the first cylinder and the first rocker arm of the second cylinder. The second oil control valve is activated to provide a second pressure at the first and second rocker arms of the third cylinder and the second rocker arm of the second cylinder. The first and second pressures are substantially equivalent.

According to still other features, the engine further comprises a fourth, fifth and sixth cylinder. Each cylinder has a first and second intake valve that are actuated by respective first and second rocker arms. A third oil control valve is provided. The third oil control valve is in pressure communication with (i) the first rocker arm of the fourth cylinder, (ii) the second rocker arm of the fourth cylinder, and (iii) the first rocker arm of the fifth cylinder. A fourth oil control valve is provided. The fourth oil control valve is in pressure communication with (i) the first rocker arm of the sixth cylinder, (ii) the second rocker arm of the sixth cylinder, and (iii) the second rocker arm of the fifth cylinder. The third oil control valve is activated thereby actuating the first and second rocker arm of the fourth cylinder and the first rocker arm of the fifth cylinder. The fourth oil control valve is activated thereby actuating the first and second rocker arm of the sixth cylinder and the second rocker arm of the fifth cylinder.

In other features, the third oil control valve is activated to provide a third pressure at the first and second rocker arms of the fourth cylinder and the first rocker arm of the fifth cylinder. The fourth oil control valve is activated to provide a fourth pressure at the first and second rocker arms of the sixth cylinder and the second rocker arm of the fifth cylinder. The first, second, third and fourth pressures are substantially equivalent. The first and second intake valves attached to the first engine cylinder are opened from about 30 to 300 crank angle degrees. The first and second intake valves attached to the second engine cylinder are opened from about 270 to about 540 crank angle degrees. The first and second intake valves attached to the third engine cylinder are opened from about 510 to about 60 crank angle degrees. A switching rocker arm associated with the first, second and third cylinder is actuated throughout a combustion cycle of the engine. The first and second oil control valves are interchangeable. The first, second, third and fourth valves are interchangeable and common relative to each other.

Further areas of applicability of the present disclosure will become apparent from the detailed description provided hereinafter. It should be understood that the detailed description and specific examples are intended for purposes of illustration only and are not intended to limit the scope of the disclosure.

BRIEF DESCRIPTION OF THE DRAWINGS

The present disclosure will become more fully understood from the detailed description and the accompanying drawings, wherein.

DETAILED DESCRIPTION

Figure 1:
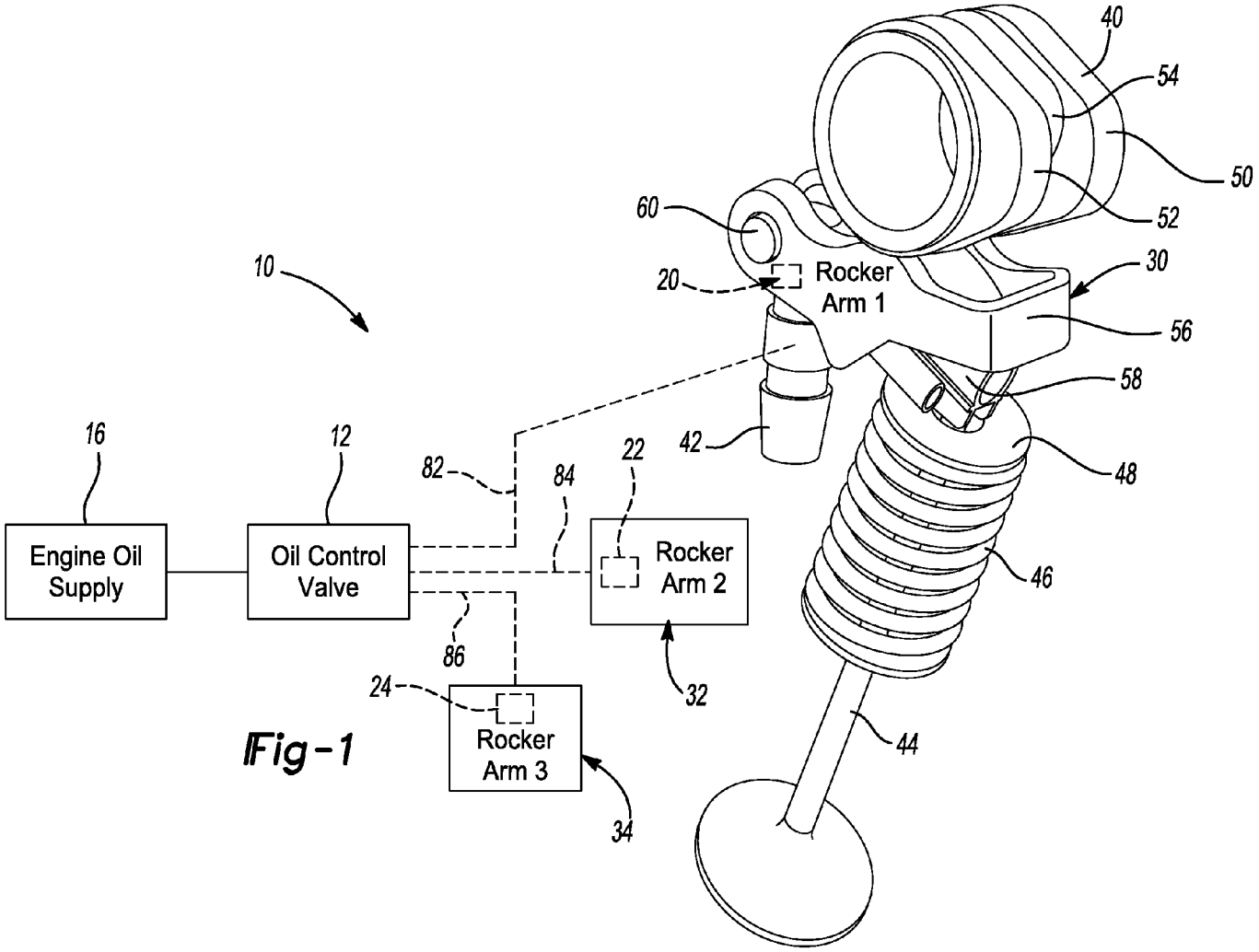
FIG. 1 is a partial schematic diagram illustrating an oil control valve system constructed in accordance to one configuration of the present teachings and shown having one oil control valve communicating with three switching mechanisms.

With initial reference to FIG. 1, an oil control valve system constructed in accordance to one example of the present teachings is shown and generally identified at reference numeral 10. The oil control valve system 10 generally includes an oil control valve 12 that is in fluid communication with an engine oil supply 16. In this regard, the oil control valve 12 is supplied oil from the engine oil supply 16. The oil control valve 12 communicates oil to each of a first, second and third switching mechanism 20, 22 and 24 associated with a first, second and third switching rocker arm 30, 32 and 34, respectively. In this regard, the oil control valve system 10 allows a single oil control valve 12 to regulate the flow of pressurized oil to the switching mechanisms 20, 22 and 24. As will become appreciated from the following discussion, the oil control valve system 10 can be provided as multiple separate oil control valve systems that deliver oil to rocker arms on a single engine. Each oil control valve system 10 operates with a common or interchangeable oil control valve 12.

With continued reference to FIG. 1, the switching rocker arm 30 will be briefly described. It will be appreciated that the configuration and function of the rocker arm 30 is merely exemplary and that the oil control valve system 10 can be suitable for other VVT or VVA configurations. For example, other valvetrain and rocker arm configurations suitable for accommodating the oil control valve system 10 may be found in commonly owned and co-pending U.S. Provisional Patent Application Ser. No. 61/722,765 entitled "DEVELOPMENT OF A SWITCHING ROLLER FINGER FOLLOWER FOR CYLINDER DEACTIVATION IN GASOLINE ENGINE APPLICATIONS", the disclosure of which is fully incorporated herein.

While only the switching rocker arm 30 is shown in detail, the rocker arms 32 and 34 are constructed similarly. The switching rocker arm 30 can include a three lobed cam 40, a lash adjuster 42, a valve 44, a spring 46 and a spring retainer 48. The three lobed cam 40 has a first and a second high-lift lobe 50, 52 and a low lift lobe 54. The switching rocker arm 30 has an outer arm 56 and an inner arm 58. During operation, the high lift lobes 50, 52 contact the outer arm 56 while the low lift lobe 54 contacts the inner arm 58. The lobes 50, 52 and 54 cause periodic downward movement of the outer arm 56 and the inner arm 58. The downward motion is transferred to the valve 44 by the inner arm 58, thereby opening the valve 44. The switching mechanism 20 of the switching rocker arm 30 switches between a high lift mode and a low lift mode. It will be appreciated that the switching mechanisms 22 and 24 are configured similarly. Actuation of the switching mechanism 20 between the low and high lift modes results from pressurized oil communicated from the oil control valve 12. In the particular example shown, the oil control valve 12 delivers oil at higher pressure to switch the switching mechanism 20 to a low lift mode. In one example, the switching mechanism 20 includes a latch assembly that selectively latches the inner arm and outer arms for concurrent movement. The switching rocker arm 30 then alters the intake valve opening and closing by varying the lift provided by the arm. Other configurations are contemplated. For example, while the above configuration is directed toward a default latched condition where oil is delivered to the switching mechanism 20 to change the operating state from latched to unlatched, the configuration may be reversed such that the default condition is unlatched where oil is delivered to the switching mechanism 20 to change the operating state from unlatched to latched.

In the high lift mode, the outer arm 56 is latched to the inner arm 58. During engine operation, the high lift lobes 50, 52 periodically push the outer arm 56 downward. Because the outer arm 56 is latched to the inner arm 58, the high lift motion is transferred from the outer arm 56 to the inner arm 58 and further to the valve 44.

When the switching rocker arm 30 is in an unswitched mode, the outer arm 56 is not latched to the inner arm 58, and so high lift movement exhibited by the outer arm 56 is not transferred to the inner arm 58. Instead, the low lift lobe 54 contacts the inner arm 58 and generates low lift motion that is transferred to the valve 44. When unlatched from the inner arm 58, the outer arm 56 pivots about an axle 60, but does not transfer motion to the valve 44. Further explanation of the switching rocker arm 30 and related latch assembly may be found in commonly owned and co-pending U.S. Patent Application Publication No. 2011/0226208 entitled "SWITCHING ROCKER ARM", the disclosure of which is fully incorporated herein.

Figure 2:
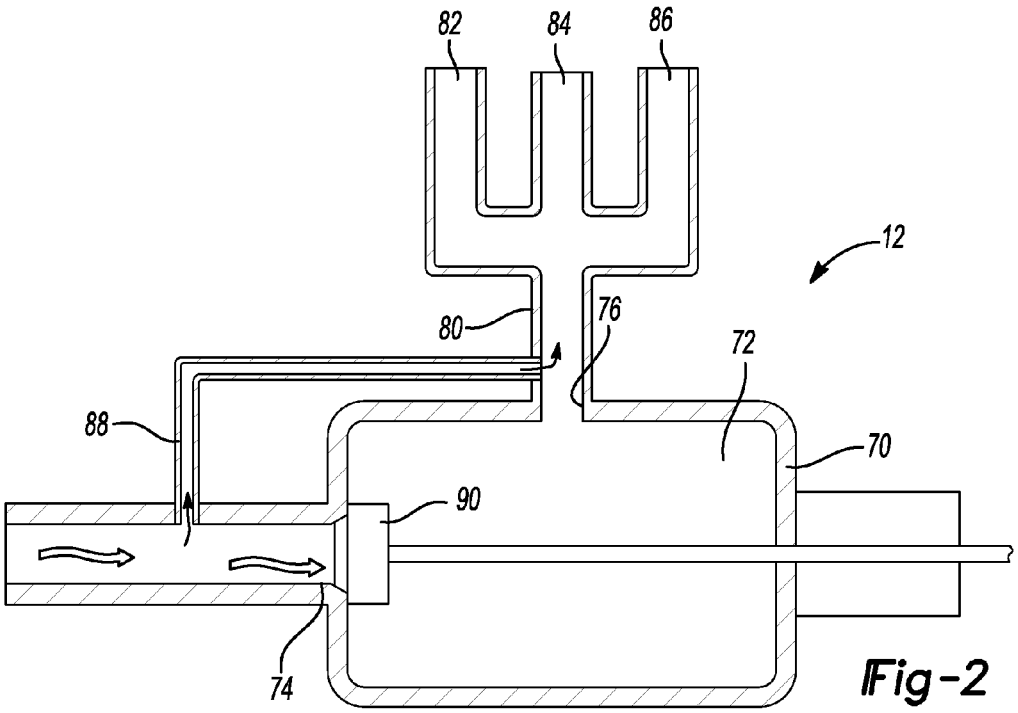
FIG. 2 is a schematic diagram of the oil control valve of FIG. 1 and shown in a closed position.
Figure 3:
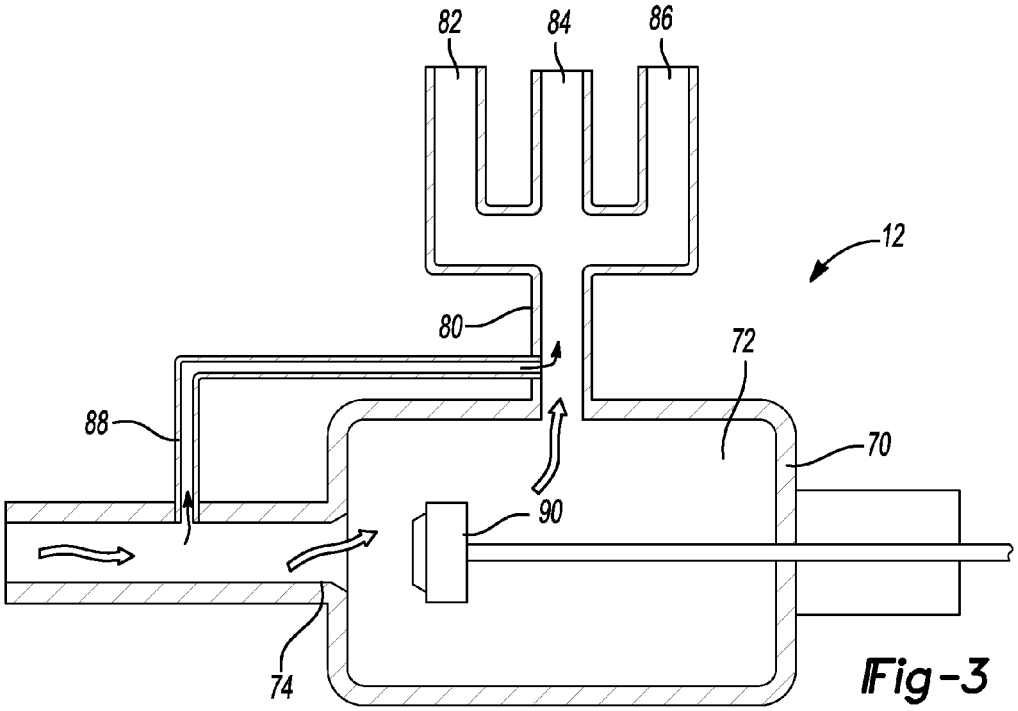
FIG. 3 is a schematic diagram of the oil control valve of FIG. 2 and shown in an open position.

With further reference now to FIGS. 2 and 3, additional features of the oil control valve 12 will be described. It will be appreciated by those skilled in the art that the depiction of the oil control valve 12 is merely exemplary and other configurations may be employed for delivering oil from the engine oil supply 16 to the respective switching mechanisms 20, 22 and 24 of the switching rocker arms 30, 32 and 34, respectively. In general, the oil control valve 12 has a valve body 70 that defines a cavity 72. The valve body defines a high pressure oil inlet 74 and an outlet 76. In the example shown, the outlet 76 delivers oil to a primary oil delivery line 80 that separates into discrete oil delivery lines 82, 84 and 86. The oil delivery lines 82, 84 and 86 fluidly connect to the switching mechanisms 20, 22 and 24, respectively. A bypass oil line 88 can deliver a nominal oil pressure continuously to the respective switching mechanisms 20, 22 and 24 regardless of an operational state of the oil control valve 12. The oil pressure provided by the bypass oil line 88 is insufficient to alter the switching mechanisms 20, 22 and 24.

The oil control valve 12 includes a solenoid plunger 90 that actuates between a first position (FIG. 2) and a second position (FIG. 3). When the oil control valve 12 is in an "OFF" state, the high pressure oil inlet 74 is blocked by the solenoid plunger 90. The respective switching mechanisms 20, 22 and 24 do not receive pressurized oil in this state. FIG. 3 shows the oil control valve 12 in an "ON" state. In this state, the plunger 90 is withdrawn from the inlet 74, allowing high pressure oil to flow from the inlet 74, through the cavity 72 to the outlet 76. The switching mechanisms 20, 22 and 24 receive pressurized oil in this state by way of respective oil delivery lines 82, 84 and 86.

With continued reference to FIGS. 1-3 and additional reference to FIG. 4, the oil control valve system 10 will be described in greater detail and implemented in an engine 100 having six cylinders numbered one to six. The engine 100 has two cylinder banks 102 and 104 with three cylinders in each cylinder bank. As shown, the oil control valve 12 delivers oil through oil delivery lines 82, 84 and 86 to the switching mechanisms 20, 24 and 26 of the respective switching rocker arms 30, 32 and 34.

The engine 100 has intake valves numbered $I_{X,Y}$ where X corresponds to the cylinder number and Y has the values 1 or 2, corresponding to the first or second valve. The intake valves $I_{X,Y}$ selectively actuate to allow air to enter the combustion chambers of the cylinders. The engine 100 further includes exhaust valves numbered $E_{X,Y}$ where X corresponds to the cylinder number and Y has the values 1 or 2, corresponding to the first or second valve. The exhaust valves $E_{X,Y}$ selectively actuate to allow emissions to exit the combustion chambers of the cylinders.

The oil delivery lines 82, 84 and 86 allow the oil control valve 12 to maintain operable pressure communication with the respective switching mechanisms 20, 22 and 24 of the rocker arms 30, 32 and 34. While the switching mechanisms 20, 22 and 24 are generally depicted as incorporated into the rocker arms 30, 32 and 34, they may be incorporated into another feature such as a respective lash adjuster (see lash adjuster 42, FIG. 1). Furthermore, while the instant description is specifically directed toward oil control valve systems for use with the intake valves, one skilled in the art will readily appreciate that a similar system may be used for use with the exhaust valves.

According to the present disclosure, the oil control valve system 10 is replicated as oil control valve system 110, 210 and 310. In this regard, a second oil control valve 112 delivers oil through oil lines 182, 184 and 186 to switching mechanisms 120, 122 and 124 of respective switching rocker arms 130, 132 and 134. Similarly, a third oil control valve 212 delivers oil through oil lines 282, 284 and 286 to switching mechanisms 220, 222 and 224 of respective switching rocker arms 230, 232 and 234. Additionally, a fourth oil control valve 312 delivers oil through oil lines 382, 384 and 386 to switching mechanisms 320, 322 and 324 of respective switching rocker arms 330, 332 and 334. In sum, each of the oil control valves 12, 112, 212 and 312 deliver oil to three of twelve switching rocker arms. Again, according to additional aspects of the present disclosure, interchangeable oil control valves can be similarly incorporated to facilitate opening of the exhaust valves. Moreover, while the engine 100 is shown with two engine banks 102 and 104, the engine 100 may incorporate one, three or four banks. In an engine configuration having one engine bank, two common and interchangeable oil control valves would control six intake valves of three engine cylinders.

Figure 4:
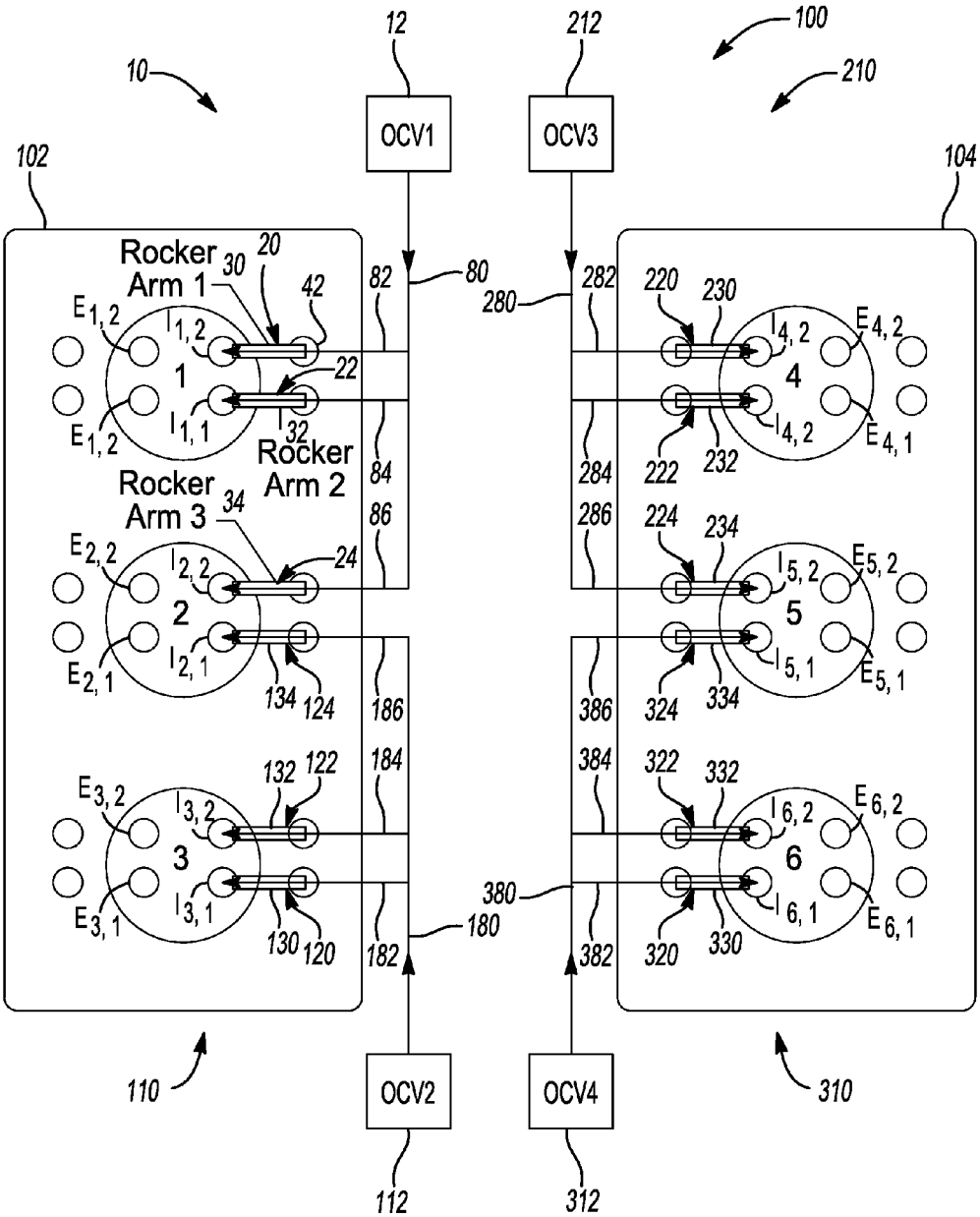
FIG. 4 is a detailed schematic diagram depicting an oil control valve system having four common oil control valves that each communicate oil to three switching mechanisms in a six cylinder engine.
Figure 5:
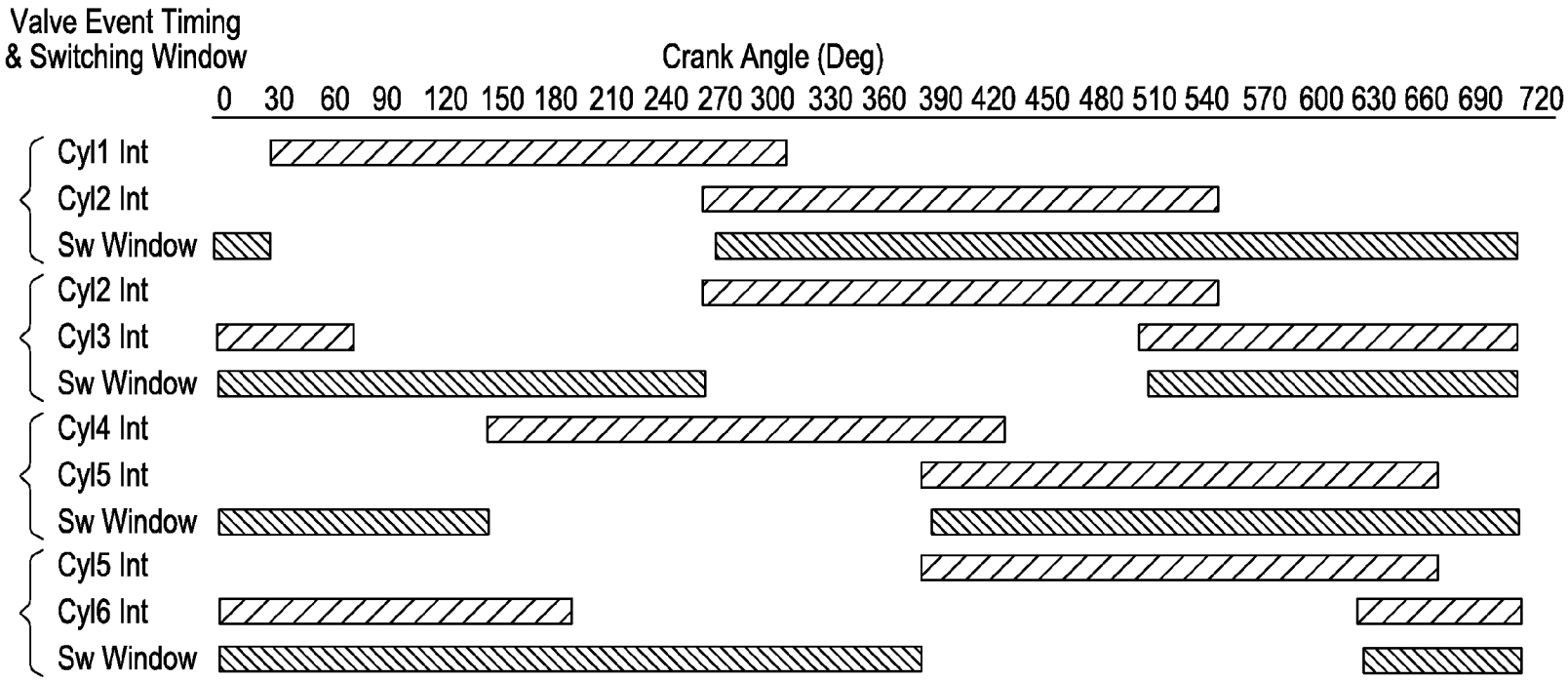
FIG. 5 is a graph demonstrating various valve-timing events and switching window periods in a high lift mode accordance with one example of the present disclosure.

FIG. 5 is a graph illustrating valve-timing events and switching window periods for the engine 100 shown in FIG. 4. Briefly, a switching window can be generally defined as a crank angle window or time available to switch between the high lift mode and the low lift mode. As shown in FIG. 5, the intake valves $I_{1,1}$ and $I_{1,2}$ attached to the first cylinder open from about 30 to about 300 crank angle degrees. The intake valves $I_{2,1}$ and $I_{2,2}$ attached to the second cylinder open from about 270 to about 540 crank angle degrees. The intake valves $I_{3,1}$ and $I_{3,2}$ attached to the third cylinder open from about 510 to about 60 crank angle degrees. The intake valves $I_{4,1}$ and $I_{4,2}$ attached to the fourth cylinder open from about 150 to about 420 crank angle degrees. The intake valves $I_{5,1}$ and $I_{5,2}$ attached to the fifth cylinder open from about 390 to about 660 crank angle degrees. The intake valves $I_{6,1}$ and $I_{6,2}$ attached to the sixth cylinder open from about 630 to about 180 crank angle degrees.

A switching window for the first and second cylinders is open from about 275 to 30 crank angle degrees. The switching window for the second and third cylinders is open from about 515 to 270 crank angle degrees. The switching window for the fourth and fifth cylinders is open from about 395 to 150 crank angle degrees. The switching window for the fifth and sixth cylinders is open from about 635 to 390 crank angle degrees.

With continued reference to FIG. 5, the total switching window for the first and second cylinders is 475 crank angle degrees. Similarly, the total switching window for the second and third cylinders, fourth and fifth cylinders, and fifth and sixth cylinders is 475 degrees. The switching window for any given cylinder is limited only by the switching window lag needed to avoid critical shift. A brief description of critical shift will now be described. In prior art systems that switch between a high lift mode and a low lift mode, a latch may slip and become only partially engaged with the rocker arm during high lift mode without adversely affecting performance. However, if the latch slips further and becomes fully disengaged, a valve spring accelerates to cause an impact between a bearing and a cam shaft. Such a slip may be referred to as a critical shift. This improper impacting can cause engine strain, wear, and rounding of engine components. Repeated critical shifts can prevent an engine from operating reliably.

The switching windows shown in FIG. 5 lag behind the opening of a valve to avoid delivering pressure to a rocker arm at an improper time in the combustion cycle. Such a lag avoids a critical shift in the engine, such as the critical shift described above. In the example provided, the switching window lags behind the opening of the intake valves by about five degrees. The oil control valve systems 10, 112, 212 and 312 shown in FIG. 4 provides a maximized switching window across multiple cylinders (see also FIG. 5), which in turn maximizes the opportunity to move a switching mechanism during a combustion cycle. This is desirable when the engine is operating at high speeds or low temperatures because an oil control valve has less time to move a switching mechanism at high speeds. At low temperatures, oil viscosity increases and switching time increases. As one example, an engine is considered to operate reliably when the total switching window for the engine system is about 480 crank angle degrees to about 715 crank angle degrees. This can be about five percent to about 50 percent more time to actuate a switching mechanism as compared with an oil control valve system using two different oil control valves among three cylinders. The increased window can improve cold weather or high speed performance.

As an engine cools, the viscosity of oil in the engine rises, causing the switching time to increase. The switching windows shown in FIG. 5 allow the engine more time to actuate a switching mechanism, which enhances performance at cool temperatures or at high speeds.

As discussed in detail herein, the oil control valve system of the present disclosure requires only a single oil control valve configuration. Explained further, the oil control valves 12, 112, 212 and 312 are common relative to each other and interchangeable. Utilizing interchangeable oil control valves throughout the engine 100 minimizes time and cost associated with design and assembly. Accordingly, the oil control valves 12, 112, 212 and 312 can have consistent performance attributes.

The oil control valves applied in arrangements such as those shown in FIG. 4 may also be interchangeable, such as a set of oil control valves sharing a common specification, such as would be shared by commonly manufactured parts of a particular part number. Common oil control valves will apply consistent pressure output to the engine cylinders when coupled to a given pressure source such as the engine oil supply 16. The oil control valve configuration according to the present disclosure has two sets of two common oil control valves. Two oil control valves 12 and 112 are implemented on one engine bank 102. Two oil control valves 212 and 312 are implemented on the other engine bank 104. The configuration of the two oil control valves 212 and 312 is substantially symmetric to the two oil control valves 12 and 112.

By incorporating four common or interchangeable valves 12, 112, 212 and 312 throughout the engine 100, common valve characteristics can be realized. For example, common characteristics can include, steady state output pressure as a function of input pressure; valve opening/closing characteristics such as the speed of the opening or closing; any delay in opening or closing, and transient behaviors of oil flow on opening and closing of the valve. It will be appreciated that oil control valves having a different configuration than one another yet be within specifications for use according to aspects of the present disclosure.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. An oil control valve system for an engine having first, second, third, fourth, fifth and sixth engine cylinders, each engine cylinder having a first and a second intake valves in operable contact with a respective switching rocker arm, the oil control valve system comprising:

a first oil control valve in operable pressure communication with switching mechanisms of a first and second switching rocker arms of the first engine cylinder, and a switching mechanism of a first switching rocker arm of the second engine cylinder;

a second oil control valve in operable pressure communication with switching mechanisms of a first and second switching rocker arms of the third engine cylinder, and a switching mechanism of a second switching rocker arm of the second engine cylinder;

a third oil control valve in operable pressure communication with switching mechanisms of a first and second switching rocker arms of the fourth engine cylinder, and a switching mechanism of a first switching rocker arm of the fifth engine cylinder; and a fourth oil control valve in operable pressure communication with switching mechanisms of a first and second switching rocker arms of the sixth engine cylinder, and a switching mechanism of a second switching rocker arm of the fifth engine cylinder.

2. The oil control valve system of claim 1 wherein the first, second, third and fourth oil control valves are each configured to provide a common output pressure to a switching mechanism of each respective switching rocker arm for a predetermined input pressure.

3. The oil control valve system of claim 1 wherein the first, second, third and fourth oil control valves are interchangeable.

4. The oil control valve system of claim 1 wherein the first, second, third and fourth oil control valves are common oil control valves relative to each other.

5. The oil control valve system of claim 1 wherein the first and second intake valves attached to the first engine cylinder open from 30 to 300 crank angle degrees, intake valves attached to the second cylinder open from 270 to 540 crank angle degrees, intake valves attached to the third cylinder open from 510 to 60 crank angle degrees, intake valves attached to the fourth engine cylinder open from 150 to 420 crank angle degrees, intake valves attached to the fifth engine cylinder open from 390 to 660 crank angle degrees, intake valves attached to the sixth engine cylinder open from 630 to 180 crank angle degrees, wherein each oil control valve of the first, second, third and fourth oil control valves actuates a switching rocker arm associated with two distinct cylinders of the first, second, third, fourth, fifth and sixth engine cylinders.

6. The oil control valve system of claim 5 wherein a first switching window for the first and second cylinders is open from 275 to 30 crank angle degrees, a second switching window for the second and third cylinders is open from 515 to 270 crank angle degrees, a switching window for the fourth and fifth cylinders is open from 395 to 150 crank angle degrees, and a switching window for the fifth and sixth cylinders is open from 635 to 390 crank angle degrees, and wherein:

(i) the first oil control valve actuates a switching rocker arm associated with the first and second cylinders throughout an engine combustion cycle;

(ii) the second oil control valve actuates a switching rocker arm associated with the second and third cylinders throughout the engine combustion cycle;

(iii) the third oil control valve actuates a switching rocker arm associated with the fourth and fifth cylinders throughout the engine combustion cycle; and (iv) the fourth oil control valve actuates a switching rocker arm associated with the fifth and sixth cylinders throughout the engine combustion cycle.

7. An oil control valve system for an engine having first, second and third engine cylinders, each engine cylinder having a first and a second intake valves in operable contact with a respective switching rocker arm, the oil control valve system comprising:

a first oil control valve in operable pressure communication with switching mechanisms of a first and second switching rocker arms of the first engine cylinder, and a switching mechanism of a first switching rocker arm of the second engine cylinder; and a second oil control valve in operable pressure communication with switching mechanisms of a first and second switching rocker arms of the third engine cylinder, and a switching mechanism of a second switching rocker arm of the second engine cylinder.

8. The oil control valve system of claim 7 wherein the first and second oil control valves are each configured to provide a common output pressure to a switching mechanism of a switching rocker arm for a predetermined input pressure.

9. The oil control valve system of claim 7 wherein the first and second oil control valves are interchangeable.

10. The oil control valve system of claim 7 wherein the first and second oil control valves are common oil control valves relative to each other.

11. The oil control valve system of claim 7 wherein the first and second oil control valves are opened for 270 crank angle degrees.

12. The oil control valve system of claim 11 wherein a switching window is delayed by 5 crank angle degrees.

13. The oil control valve system of claim 11 wherein a total switching window is 480 crank angle degrees.

14. A method for operating an oil control valve system fluidly coupled to a plurality of switching mechanisms provided in respective rocker arms of an engine, the engine having first, second and third cylinders, each cylinder having a first and a second intake valves that is actuated by respective first and second rocker arms, the method comprising:

providing a first oil control valve, the first oil control valve in pressure communication with (i) the first rocker arm of the first cylinder, (ii) the second rocker arm of the first cylinder; and (iii) the first rocker arm of the second cylinder, providing a second oil control valve, the second oil control valve in pressure communication with (i) the first rocker arm of the third cylinder, (ii) the second rocker arm of the third cylinder, and (iii) the second rocker arm of the second cylinder;

activating the first oil control valve, thereby actuating the first and second rocker arms of the first cylinder and the first rocker arm of the second cylinder; and activating the second oil control valve, thereby actuating the first and second rocker arms of the third cylinder and the second rocker arm of the second cylinder.

15. The method of claim 14 further comprising:

activating the first oil control valve to provide a first pressure at the first and second rocker arms of the first cylinder and the first rocker arm of the second cylinder; and activating the second oil control valve to provide a second pressure at the first and second rocker arms of the third cylinder and the second rocker arm of the second cylinder, wherein the first and second pressures are substantially equivalent.

16. The method of claim 15 further comprising:

activating the third oil control valve to provide a third pressure at the first and second rocker arms of the fourth cylinder and the first rocker arm of the fifth cylinder; and activating the fourth oil control valve to provide a fourth pressure at the first and second rocker arms of the sixth cylinder and the second rocker arm of the fifth cylinder, wherein the first, second, third and fourth pressures are substantially equivalent.

17. The method of claim 16 wherein the first, second, third and fourth oil control valves are interchangeable and common relative to each other.

18. The method of claim 14 wherein the engine further comprises a fourth, fifth and sixth cylinder, each cylinder having a first and a second intake valves that are actuated by respective first and second rocker arms, the method further comprising:

providing a third oil control valve, the third oil control valve in pressure communication with (i) the first rocker arm of the fourth cylinder, (ii) the second rocker arm of the fourth cylinder; and (iii) the first rocker arm of the fifth cylinder, providing a fourth oil control valve, the fourth oil control valve in pressure communication with (i) the first rocker arm of the sixth cylinder, (ii) the second rocker arm of the sixth cylinder, and (iii) the second rocker arm of the fifth cylinder;

activating the third oil control valve, thereby actuating the first and second rocker arms of the fourth cylinder and the first rocker arm of the fifth cylinder; and activating the fourth oil control valve, thereby actuating the first and second rocker arms of the sixth cylinder and the second rocker arm of the fifth cylinder.

19. The method of claim 14, further comprising:

opening the first and second intake valves attached to the first engine cylinder from 30 to 300 crank angle degrees, opening the first and second intake valves attached to the second engine cylinder from 270 to 540 crank angle degrees, opening the first and second intake valves attached to the third engine cylinder form 510 to 60 crank angle degrees, and actuating a switching rocker arm associated with the first, second and third cylinders throughout a combustion cycle of the engine.

20. The method of claim 14 wherein the first and second oil control valves are interchangeable.

* * * * *